US009796191B2

(12) United States Patent
Wang et al.

(10) Patent No.: US 9,796,191 B2
(45) Date of Patent: Oct. 24, 2017

(54) METHOD OF INKJET PRINTING DECORATIONS ON SUBSTRATES

(71) Applicant: CORNING INCORPORATED, Corning, NY (US)

(72) Inventors: Qingya Wang, Shanghai (CN); Yongsheng Yan, Fuzhou (CN); Fang-Fang Wang, Zhubei (TW)

(73) Assignee: CORNING INCORPORATED, Corning, NY (US)

( * ) Notice: Subject to any disclaimer, the term of this patent is extended or adjusted under 35 U.S.C. 154(b) by 0 days.

(21) Appl. No.: 14/966,837

(22) Filed: Dec. 11, 2015

(65) Prior Publication Data

US 2016/0271971 A1 Sep. 22, 2016

Related U.S. Application Data

(60) Provisional application No. 62/135,855, filed on Mar. 20, 2015.

(51) Int. Cl.
*B41J 2/01* (2006.01)
*B41J 11/00* (2006.01)
(Continued)

(52) U.S. Cl.
CPC ..... *B41J 11/0015* (2013.01); *B41M 5/007* (2013.01); *B41M 5/0047* (2013.01);
(Continued)

(58) Field of Classification Search
CPC ..... B41J 11/002; B41J 11/0015; B41J 2/01; B41J 2/2107; B41J 2/2114; B41M 5/0047;
(Continued)

(56) References Cited

U.S. PATENT DOCUMENTS 4,093,771 A 6/1978 Fletcher et al.
4,148,057 A 4/1979 Jesse
(Continued)

FOREIGN PATENT DOCUMENTS

EP 1661729 5/2006
EP 2353881 A1 8/2011
(Continued)

OTHER PUBLICATIONS

Patent Cooperation Treaty International Notification of Transmittal of the International Search Report and The Written Opinion of the International Searching Authority, international application No. PCT/US2014/059995; dated Jan. 21, 2015, 10 pages.
(Continued)

*Primary Examiner* — Jannelle M Lebron
(74) *Attorney, Agent, or Firm* — John T. Haran

(57) ABSTRACT

A method of printing a decoration on a substrate include inkjet printing a plurality of inks to form a layer having a predetermined pattern on a surface of the substrate, wherein each of the inks includes a solvent and has a different color; heating the substrate to evaporate at least a portion of the solvent in each of the plurality of inks; and thermally curing the layer after evaporating at least the portion of the solvent in each of the plurality of inks to form the decoration. The substrate is heated to a temperature that evaporates at least the portion of the solvent in each of the plurality of inks without fully curing the plurality of inks. A boiling point of the solvent in each of the plurality of inks is within 10° C. of each other.

18 Claims, 6 Drawing Sheets
(2 of 6 Drawing Sheet(s) Filed in Color)

(51) Int. Cl.
*B41M 5/00* (2006.01)
*B41M 7/00* (2006.01)
*B41M 5/24* (2006.01)

(52) U.S. Cl.
CPC ..... *B41M 7/009* (2013.01); *B41M 5/0058* (2013.01); *B41M 5/0064* (2013.01); *B41M 5/24* (2013.01)

(58) Field of Classification Search
CPC .. B41M 5/007; B41M 7/0027; B41M 5/0011; B41M 5/24; B41M 7/009
USPC ..... 347/100, 101, 102, 104
See application file for complete search history.

(56) References Cited

U.S. PATENT DOCUMENTS

| | | | | |
|---|---|---|---|---|
| 4,500,587 | A | 2/1985 | Kamaishi et al. | |
| 5,314,522 | A | 5/1994 | Kondo et al. | |
| 5,370,913 | A | 12/1994 | Lin | |
| 5,391,247 | A | 2/1995 | Kamen et al. | |
| 5,449,426 | A | 9/1995 | Lin | |
| 5,520,973 | A | 5/1996 | Kamen et al. | |
| 5,562,951 | A | 10/1996 | Kamen | |
| 5,678,481 | A | 10/1997 | Matsumoto et al. | |
| 5,871,879 | A | 2/1999 | Verlinden et al. | |
| 6,211,308 | B1 * | 4/2001 | Saint Victor | D06M 14/18 427/513 |
| 6,336,723 | B1 | 1/2002 | Nicolin | |
| 6,487,386 | B1 | 11/2002 | Zimmer et al. | |
| 6,599,576 | B1 | 7/2003 | Leach | |
| 8,334,464 | B2 | 12/2012 | Edwards et al. | |
| 8,463,260 | B2 | 6/2013 | Wu | |
| 2003/0085209 | A1 | 5/2003 | Lu | |
| 2006/0141391 | A1 | 6/2006 | Klein et al. | |
| 2006/0281334 | A1 | 12/2006 | Shin et al. | |
| 2007/0014974 | A1 | 1/2007 | Vronsky | |
| 2007/0065735 | A1 | 3/2007 | Kim | |
| 2007/0108170 | A1 | 5/2007 | Costin, Sr. et al. | |
| 2007/0151178 | A1 | 7/2007 | Baikerikar et al. | |
| 2008/0056951 | A1 | 3/2008 | Angros | |
| 2009/0074997 | A1 | 3/2009 | Stark | |
| 2010/0182686 | A1 | 7/2010 | Fukushima et al. | |
| 2010/0208021 | A1 * | 8/2010 | Hori | B41J 2/0057 347/102 |
| 2011/0126760 | A1 | 6/2011 | Daems et al. | |
| 2011/0234727 | A1 | 9/2011 | Aoki et al. | |
| 2012/0114921 | A1 | 5/2012 | Tsuda | |
| 2014/0204145 | A1 * | 7/2014 | Ohnishi | B41J 11/002 347/102 |
| 2014/0347429 | A1 * | 11/2014 | Gould | C09D 11/101 347/100 |
| 2015/0103123 | A1 | 4/2015 | Chen et al. | |

FOREIGN PATENT DOCUMENTS

| | | | |
|---|---|---|---|
| GB | 2362605 | A | 11/2001 |
| GB | 2423053 | B | 6/2007 |
| JP | 57063263 | A | 4/1982 |
| JP | 02263739 | A | 10/1990 |
| JP | 06032922 | A | 2/1994 |
| JP | 2003034016 | A | 2/2003 |
| JP | 2003146679 | A | 5/2003 |
| JP | 2007168199 | A | 7/2007 |
| WO | 9929789 | A1 | 6/1999 |
| WO | 03/020527 | | 3/2003 |
| WO | 2005022969 | | 3/2005 |
| WO | 2005051856 | | 6/2005 |
| WO | 2008069588 | | 6/2008 |
| WO | 2009118507 | A1 | 10/2009 |
| WO | 2010069749 | A1 | 6/2010 |
| WO | 2011/135398 | | 11/2011 |
| WO | 2015057500 | A1 | 4/2015 |

OTHER PUBLICATIONS

International Search Report and Written Opinion PCT/US2016/023034 dated Sep. 27, 2016.

* cited by examiner

FIG. 2
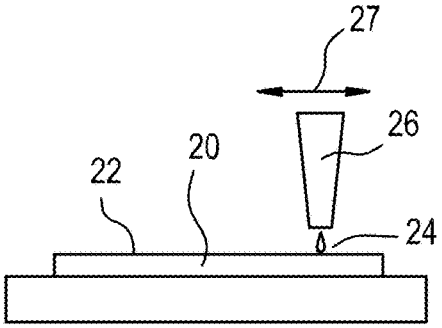
FIG. 4B
FIG. 4A
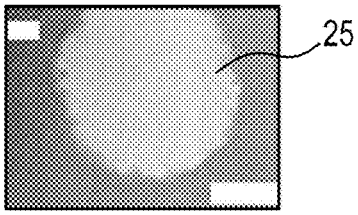
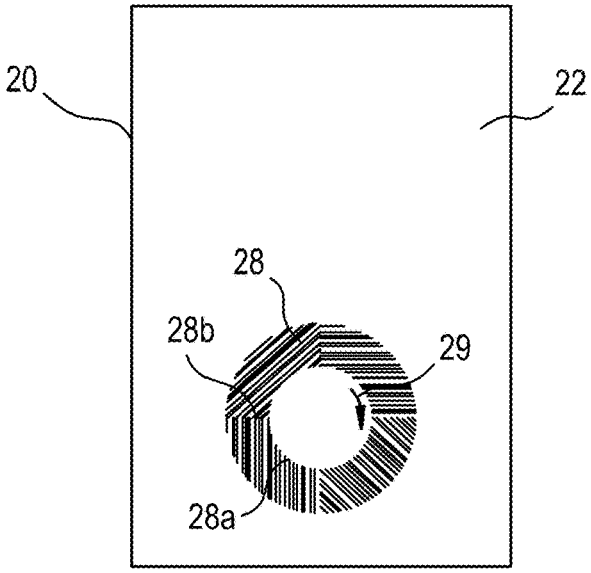

METHOD OF INKJET PRINTING DECORATIONS ON SUBSTRATES

CROSS-REFERENCE TO RELATED APPLICATIONS

This application claims the benefit of priority under 35 U.S.C. §119 of U.S. Provisional Application Ser. No. 62/135855 filed on Mar. 20, 2015 the content of which is relied upon and incorporated herein by reference in its entirety.

FIELD

The field relates to methods for inkjet printing decorations on substrates.

BACKGROUND

In recent years there has been an explosive growth in the use of glass as cover lens (also referred to as cover glass) for consumer electronic devices with displays, such as mobile phones, tablets, and laptop computers. Part of the reason for this explosion is due to increased resistance of glass cover lenses to damage as a result of improvements in glass manufacturing processes and compositions. Glass cover lenses also improve the tactile feel of touch display operation while enhancing the aesthetic appeal of the devices.

Glass cover lenses typically have decorations printed on them for various reasons. One use of decorations is to mask the electronic components in the interior of the device from the view of the user. Another use of decorations is as logos that distinguish one product or brand from another. Decorations may also function as icons that indicate the status of the device or location for touch buttons. Decorations may also be used to simply enhance the aesthetic appeal of the device.

Decorations are typically in the form of ink coatings on the surfaces of the cover lenses. To be suitable for the uses mentioned above, the ink coating should maintain adhesion and color under all environments where the device is expected to operate. The coating should also be compatible with other functions of the device, such as being thin enough not to interfere with assembly of the cover lens to the touch display module of the device and having high enough electrical resistance not to interfere with the function of the wireless antennae of the device.

The current state of the art is to print decorations on glass cover lenses using screen printing. For repeatedly printing the same design on a large number of cover lenses, screen printing is a mature process. However, there are some challenges with screen printing. The screen printing process is constantly changing due to evaporation of solvents in the ink during printing, wear in the screen emulsion and squeegee, and loss of tension in the screen. Any environmental contamination of the screen during printing would prevent ink from being deposited onto the substrate in the contaminated areas, causing pinhole defects. These pinholes can be reworked by manually applying ink at the defect location or by printing an additional layer of the same ink over the existing ink layer to cover the defects or by stripping all the ink from the glass part and reprinting. Each of the rework methods increases cost of fabrication and risk of other defects being introduced during the additional processing.

The screen printing process is also limited in the type of patterns that can be fabricated. When applying multiple colors on the cover lens, each color has to be printed in a separate layer, with each layer being cured in between applications. The multiple steps greatly lengthen the overall processing time, increase cost of fabrication with each additional layer printer, as well as increase the rate of yield loss due to extra processing. These challenges restrict the options available to device designers for design of the cover lens. To date, device cover lenses typically have no more than six different colors, and usually only two to four different colors. Each new color used in the decorative design requires a new ink that must be separately applied from the other inks. The required customization slows the response time from new design orders to finishing of cover lenses. Accordingly, there is a need for a method of applying decorations having a plurality of patterns and/or colors, without the drawbacks of traditional printing methods, such as screen printing.

SUMMARY

The subject matter in this disclosure relates to a method of inkjet printing a plurality of inks to form a decoration on a surface of a substrate and substrate with a decoration printed on the substrate according to the methods disclosed herein. The decoration can be a design, a logo, an emblem, or other graphic. In some embodiments, the decoration can be a "photorealistic" graphic that appears to be an actual photograph, painting, or picture. The method produces decorations with highly defined features and affords design flexibilities that are not generally possible with traditional printing methods such as screen printing.

A method of printing a decoration includes inkjet printing a plurality of inks to form a layer having a predetermined pattern on a surface of a substrate, wherein each of the inks includes a solvent and has a different color; heating the substrate to evaporate at least a portion of the solvent in each of the plurality of inks; and thermally curing the layer after evaporating at least the portion of the solvent in each of the plurality of inks to form the decoration, wherein the substrate is heated to a temperature that evaporates at least the portion of the solvent in each of the plurality of inks without fully curing the plurality of inks, and wherein a boiling point of the solvent in each of the plurality of inks is within 10° C. of each other. In some embodiments, a weight percentage of the solvent in each of the plurality of inks is within 5% of each other.

The inkjet printing processes described herein have several advantages over traditional methods of screen printing. Color ink jet printing deposits tiny ink droplets, on the order of picoliters, onto locations on the substrates defined by the drawing file, which ensures the highest possible utilization rate of the printing ink. The only wastage come from declogging of ink jet nozzles in case of clogging, and small amounts left over in the ink container when empty. Greater utilization reduces the materials cost associated with the decoration process.

Another benefit is that the colored inkjet ink does not require mixing of different components, such as base ink, hardener, solvent and other additives in the case of screen printing ink, before use. In addition, the ink is not printed via transfer media, such as screen and squeegee as in the case of screen printing. Furthermore, the color ink jet printing process can generate multiple colors in a decorative graphic in one pass, rather than one color at a time. Color variations and gradations can be achieved with varying relative percentage and density of ink droplets of each of the primary colors, as dictated by the printing software, interpreted from the drawing file. In this way, the ink jet printing process can print a multitude of colors, include photorealistic graphics, at high precision, at reasonable costs, with the only limitation being colors than cannot be ink jetted (such as metallic, IR and UV transparent colors). These attributes of the ink jet process greatly reduce the types and amount of utensils that need to be cleaned after printing, reducing cleaning costs and exposure to hazardous cleaning solvents. The operating personnel can only come in direct contact with the wet ink if they touch the wet printed ink surface before curing, which is strictly prohibited to ensure coating integrity and product quality. Without the need to procure customized ink mixtures and transfer media, color ink jet printing can produce prototypes of new decorative designs from customers in less than one day, compared to multiple days or weeks for screen printing. Lastly, without the presence of the screen that can be contaminated, ink jet printing is less vulnerable to pin hole defects caused by environmental contamination.

Another benefit is that the ink jet printed and cured color coating thickness, at 1.5 μm to 5 μm, is much thinner than achievable by screen printing, which usually produces coatings greater than 8 μm thick at the edges of the print pattern. A thinner coating is more compatible with common downstream processes in consumer electronic display device assembly as described below.

Also inkjet printing does not require the production, acquisition, printing and curing of each distinct color, as is the case in screen printing. The resolution of the inkjet printed graphics is much finer than that can be achieved by screen printing, since there is no misalignment challenges between the separate color layers (cyan, magenta, yellow and black layers) that is common in screen printing.

It is to be understood that both the foregoing general description and the following detailed description are exemplary and are intended to provide an overview or framework for understanding the nature and character of the disclosure as it is claimed. The accompanying drawings are included to provide a further understanding of the disclosure and are incorporated in and constitute a part of this specification. The drawings illustrate various embodiments of the disclosure and together with the description serve to explain the principles and operation of the disclosure.

BRIEF DESCRIPTION OF DRAWINGS

The patent or application file contains at least one drawing executed in color. Copies of this patent or patent application publication with color drawing(s) will be provided by the Office upon request and payment of the necessary fee.

The following is a description of the figures in the accompanying drawings. The figures are not necessarily to scale, and certain features and certain views of the figures may be shown exaggerated in scale or in schematic in the interest of clarity and conciseness.

FIG. 2 shows an exemplary inkjet apparatus for printing a decoration on a substrate.

FIG. 4A shows an inkjet layer with a saw edge, according to one or more embodiments.

FIG. 4B illustrates laser trimming of edges of an ink layer on a substrate, according to one or more embodiments.

DETAILED DESCRIPTION

Figure 1:
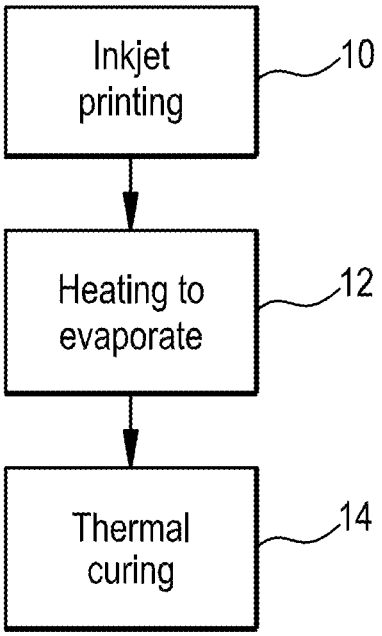
FIG. 1 shows a first exemplary process for applying decorative coatings to surfaces of substrates.

In the following detailed description, numerous specific details may be set forth in order to provide a thorough understanding of embodiments of the disclosure. However, it will be clear to one skilled in the art when embodiments of the disclosure may be practiced without some or all of these specific details. In other instances, well-known features or processes may not be described in detail so as not to unnecessarily obscure the disclosure. In addition, like or identical reference numerals may be used to identify common or similar elements.

FIG. 1 shows an exemplary process for printing a decoration on a substrate. The process includes a step 10 of inkjet printing a plurality of inks to form a layer having a predetermined pattern on a surface of a substrate, wherein each of the inks includes a solvent and has a different color; a step 12 of heating the substrate to evaporate at least a portion of the solvent in each of the plurality of inks; and a step 14 of thermally curing the layer after evaporating at least the portion of the solvent to form the decoration.

FIG. 2 is an exemplary illustration of inkjet printing the plurality of inks (step 10). In some embodiments, a substrate 20 is provided and a plurality of inks can be inkjet printed on a surface 22 of substrate 20 in the form of droplets 24 from an inkjet print head 26. In some embodiments, substrate 20 can be made of a transparent material, including, but not limited to, glass, fused silica, synthetic quartz, a glass ceramic, ceramic, and a crystalline material such as sapphire. In some embodiments, the substrate can be transparent to at least one wavelength in a range from about 390 nm to about 700 nm. In some embodiments, the substrate can transmit at least 70%, at least 75%, at least 80%, at least 85%, or at least 90% of at least one wavelength in a range from about 390 nm to about 700 nm. In some embodiments, substrate 20 can be a nontransparent material, including but not limited to a nontransparent ceramic or glass-ceramic, metal, metal oxide, or polymers. In some embodiments, substrate 20 can be glass and the glass can include alkali containing glass, alkali-free glass (for example an alkali-free alkaline aluminoborosilicate glass), or laminated glass pieces with layers containing different glass compositions. In some embodiments, substrate 20 can be glass, and the glass can be chemically strengthened, for example by an ion exchange process in which ions in the surface layer of the glass are replaced by larger ions having the same valence or oxidation state. In one particular embodiment, the ions in the surface layer and the larger ions are monovalent alkali metal cations, such as $Li^+$ (when present in the glass), $Na^+$, $K^+$, $Rb^+$, and $Cs^+$. Thus, for example, $Na^+$ present in the glass may be replaced with the larger $K^+$ ions. The ion-exchange process creates a compressive stress at the surfaces of the glass article or glass substrate sheet. These compressive stresses extend beneath the surface of the glass article or glass substrate sheet to a certain depth, referred to as the depth of layer (DOL). The compressive stresses are balanced by a layer of tensile stresses (referred to as central tension) such that the net stress in the glass article or glass substrate sheet is zero. The formation of compressive stresses at the surface of the shaped glass article makes the glass strong and resistant to mechanical damage and, as such, mitigates failure of the shaped glass article for flaws which do not extend through the depth of layer.

In some embodiments, each of the plurality of inkjet inks can include a pigment paste, one or more solvents, and/or one or more resins. In some embodiments, the plurality of inkjet inks can include additional additives such as flow promoters and degassing agents. In some embodiments, each of the plurality of inkjet inks can have a different color. The colors can include cyan, light cyan (for example, an ink having less cyan pigment than cyan), magenta, light magenta (for example, an ink having less magenta pigment than magenta), yellow, and black. Other colors can include white, light black (for example, an ink having less black pigment than black), and light, light black (for example, an ink having less black pigment than black and light black). Exemplary inkjet inks suitable for use in the processes disclosed herein include the inkjet inks described in commonly owned application Ser. No. 62/135,864 filed Mar. 20, 2015 and entitled "Inkjet Ink Composition, Ink Coating Method, and Coated Article", which is hereby incorporated by reference in its entirety.

Inkjet print head 26 can be a conventional inkjet printer head, for example those available from Epson, and can receive cartridges of the plurality of inkjet ink colors. The inkjet printer used in printing the design can be any suitable digital inkjet flatbed printer. For example, ink prints have been successfully made on surfaces using a digital inkjet flatbed printer available from 3MacJet Technologies Co., Ltd. Inkjet print head 26 deposits droplets of ink 24, on the order of picoliters, on the surface 22 at locations according to the desired design while moving back and forth along the surface 20, as indicated by the arrow 27. In some embodiments, the droplets of ink 24 have a volume in a range from about 1.5 picoliters to about 7picoliters. In some embodiments, the plurality of inks is inkjet printed in droplets of sufficient volume to form a drop having a diameter of at least 50 μm on the substrate. In some embodiments, the inkjet printing parameters are selected such that the ink layer has a thickness in a range from 1.5 μm to 5 μm, or 1.5 μm to 3 μm after curing. Inkjet printing can control (cured and dried) thickness to within ±0.15 μm. Such a thin coating is more compatible with downstream processes in consumer electronic display assembly, which generally require ink thicknesses of 5 μm or less. One such downstream process is lamination of anti-reflective, anti-splitter, or ITO coated films on the substrate, where thinner ink coating reduces risk of air bubbles between film and substrate at the ink edge. Another process is a direct bonding assembly of the printed cover lens to the touch display module, in which the thinner coating reduces risk of air bubbles at the ink edge as well as the amount of the optically clear adhesive necessary to fill in the space created by the thickness of the decorative ink.

In some embodiments, the definition of the desired design in terms of shapes and colors can be prepared using suitable graphics software and stored in a drawing file. The drawing file can then be uploaded to an inkjet printer for printing on surface 22 of substrate 20.

In step 12, substrate 20 is heated to evaporate at least a portion of the solvent(s) in each of the plurality of inks without fully curing the inks. Evaporating at least a portion of the solvent in each of the plurality of inks prior to curing, immobilizes the inkjet droplets and/or minimizes flowing of the inkjet droplets on surface 22 so that merging of the inkjet droplets is minimized, and thereby minimizes a loss of resolution in the printed pattern. In some embodiments, substrate 20 can be heated prior to, during, and/or after inkjet printing the plurality of inks in step 10. In some embodiments, substrate 20 can be heated using conventional techniques, for example with the use of a heating plate. In some embodiments, substrate 20 can be heated in a temperature in a range from about 30° C. to about 70° C., 30° C. to about 60° C., 30° C. to about 50° C., 30° C. to about 40° C., 40° C. to about 70° C., 40° C. to about 60° C., 40° C. to about 50° C., 50° C. to about 70° C., 50° C. to about 60° C., or 60° C. to about 70° C. In some embodiments, the solvents are allowed to evaporate before performing the thermal cure (step 14), for at least about 15 seconds, at least about 20 seconds, at least about 25 seconds, at least about 30 seconds, at least about 35 seconds, at least about 40 seconds, at least about 45 seconds, at least about 50 seconds, at least about 55 seconds, or at least about 1 minute. In some embodiments, at least about 40%, about 45%, about 50%, about 55%, about 60%, about 65%, about 70%, about 75% or more of each of the solvents is evaporated prior to curing. In some of the embodiments, the solvent or mixture of solvents in each of the plurality of inks have a similar volatility such that the solvent or mixture of solvents in each of the plurality of inks evaporates at a similar rate. In some embodiments, the similar volatility can be achieved by having each of the plurality of inks have a solvent that (1) has a boiling point that is within 10° C. of a solvent in each of the other plurality of inks and/or (2) has a weight percentage in the ink that is within 5% of the weight percent of a solvent in each of the other plurality of inks. This does not exclude one or more of the plurality of inks from having more than one solvent. An exemplary set of inks meeting these two requirements would be a first ink having a solvent with a boiling point of 50° C. and constitutes 5% by weight of the first ink, a second ink having a solvent with a boiling point of 55° C. and constitutes 7.5% by weight of the second ink, and a third ink having a solvent with a boiling point of 60° C. and constitutes 10% by weight of the second ink. In some embodiments, each of the plurality of inks can have two, three, four, or more solvents, wherein similar volatility can be achieved for each of the plurality of inks by having each of the solvents in the plurality of inks (1) have a boiling point that is within 10° C. of a solvent in each of the other plurality of inks and/or (2) have a weight percentage in the ink that is within 5% of the weight percent of the same solvent in each of the other plurality of inks. For example, when each of the plurality of inks has at least a first solvent and a second solvent, (1) a boiling point of the first solvent in each of the plurality of inks is within 10° C. of each other and a boiling point of the second solvent in each of the plurality of inks is within 10° C. of each other and/or (2) a weight percentage of the first solvent in each of the plurality of inks is within 5% of each other and a weight percentage of the second solvent in each of the plurality of inks is within 5% of each other. In some embodiments, having multiple solvents in each of the plurality of inks can help control the evaporate rate so that the inks do not evaporate so quickly that the inkjet dispensers do not get clogged but the inks do not evaporate too slowly that the ink is not immobilized and allowed to spread on the substrate, thereby decreasing the resolution of the pattern.

In step 14, the ink layer is thermally cured to complete cross-linking of the resins in the ink coating. Volatile components, such as the solvent(s) if still present in the ink layer after heating step 12, are driven off the ink layer during the curing, which will ensure adequate hardening of the coating and adhesion of the coating to the substrate surface. In some embodiments, the thermal curing can be achieved by exposure baking in a convection or infrared oven. In some embodiments, the thermal curing occurs at a higher temperature than heating step 12. In some embodiments, the thermal curing occurs at a temperature in a range from about 150° C. to about 250° C., about 150° C. to about 225° C., about 150° C. to about 200° C., about 150° C. to about 175° C., about 175° C. to about 250° C., about 175° C. to about 225° C., about 175° C. to about 200° C., about 200° C. to about 250° C., about 200° C. to about 225° C., or about 225° C. to about 250° C. In some embodiments, the duration for the thermal curing can be between about 1 minute and about 30 minutes, about 1 minute and about 25 minutes, about 1 minute and about 20 minutes, about 1 minute and about 15 minutes, about 1 minute and about 10 minutes, about 1 minute and about 5 minutes, about 5 minutes and about 30 minutes, about 5 minutes and about 25 minutes, about 5 minutes and about 20 minutes, about 5 minutes and about 15 minutes, about 5 minutes and about 10 minutes, about 10 minutes and about 30 minutes, about 10 minutes and about 25 minutes, about 10 minutes and about 20 minutes, about 10 minutes and about 15 minutes, about 15 minutes and about 30 minutes, about 15 minutes and about 25 minutes, about 15 minutes and about 20 minutes, about 20 minutes and about 30 minutes, about 20 minutes and about 25 minutes, or about 25 minutes and about 30 minutes. In some embodiments, after thermally curing the inks, the ink layer have an adhesion to substrate 20 of 4B or greater as measured using a Gardco cross-hatch adhesion kit in accordance with ASTM D3359-09e2 (and its progeny), which is incorporated herein by reference in its entirety. In some embodiments, to promote adhesion of the inks to the substrate the coefficient of thermal expansion (CTE) for the substrate and each of the plurality of inks is similar.

Figure 3:
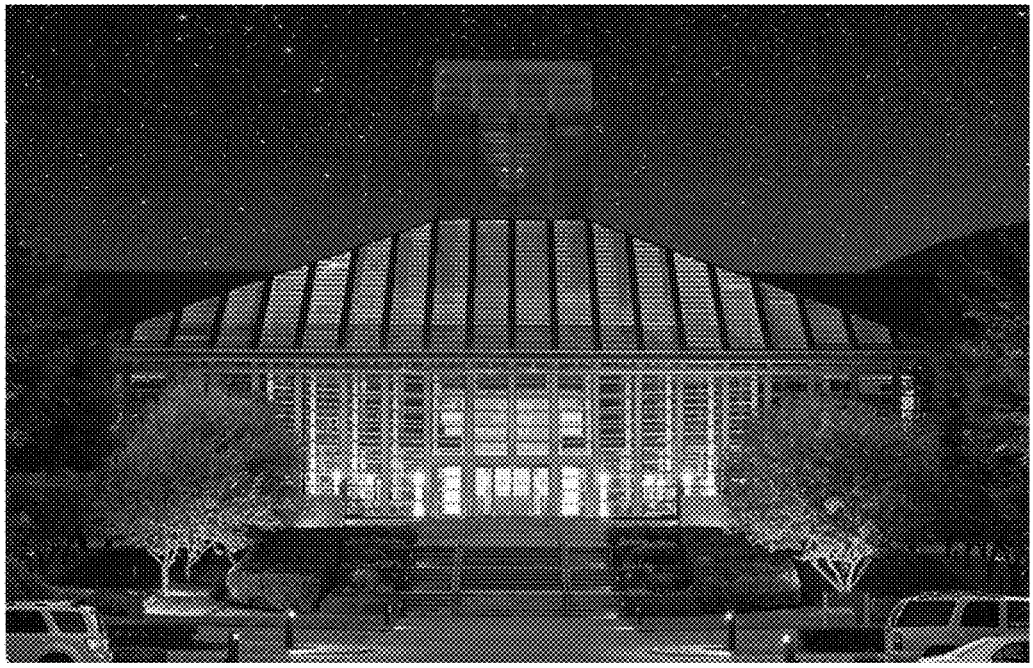
FIG. 3 is in color and shows an exemplary photorealistic graphic printed according to one or more embodiments.

Step 14 of thermal curing results in the formation of the decoration. As discussed above, the decoration can be a design, a logo, an emblem, or other graphic. In some embodiments, the decoration can be a "photorealistic" graphic that appears to be an actual photograph, painting, or picture. FIG. 3 is an exemplary "photorealistic" graphic. Substrate 20 with the inkjet printed decoration can be incorporated into an electronic device, such as a mobile device, for example as part of the cover glass/substrate or as part of the housing.

The process outlined in FIG. 1 is merely exemplary and can include additional steps, such as for example cleaning the substrate, priming the substrate, laser engraving the ink layer, and/or printing additional layers (before or after step 10) as described in more detail below. In some embodiments, prior to inkjet printing on surface 22, substrate 20 can be cleaned to remove any surface contamination that may interfere with ink deposition and adhesion. Further, in some embodiments, a primer can be applied to the surface 22 prior to deposition of the ink to assist in adhesion of the ink to the surface 22. The primer material should have good adhesion to the substrate material of the surface 22 as well as provide an adequate surface for the ink to adhere to. In other embodiments, the ink is applied directly to surface 22 (e.g., without previous application of a primer).

In some embodiments, after thermal curing step 14, additional processing can occur such as a step of laser engraving. Inkjet coatings typically have saw edges, which are due to overlapping of droplets at the edges of the coating. FIG. 4A is a microscopic image of print edge quality from an inkjet coating, where there is a saw edge 25, typically 50 to 100 μm in width. In some embodiments, laser engraving can be used to trim off the saw edge as described for example in commonly owned U.S. Pub. No. 2015/0103123, which is hereby incorporated by reference in its entirety. In laser engraving, a laser source is used to focus laser energy ("laser") on select portions of a material. In this case, the material will be the ink layer on substrate surface. FIG. 4B shows an exemplary substrate 20 having a surface 22 with an ink layer 28 printed in the shape of a ring. The shading of the different sections of the ring denotes different ink colors. The laser energy can be focused to a small area of the ink coating, e.g., around the edges of the ink layer 28 where the saw-like printing defects are located. In some embodiments, the laser can have a spot size in a range from about 20 μm to 100 μm in diameter. In some embodiments, the spot size can be less than 100 μm in diameter or less than 60 μm in diameter. The laser engraver receives the definition of the desired decoration from the drawing file. Color information of the decoration is not needed for laser engraving. As illustrated in FIG. 4B, the laser engraver will guide a laser 29 along the inner and outer edges 28*a*, 28*b* of the ink layer 28 using the received design definition. The laser energy will burn a small amount of material from the inner and outer edges of the ink coating, e.g., 50 to 100 μm of width in the ink coating can be burned off, leaving the inner and outer edges crisp and free of any a saw edge.

A thin coating of 5 μm or less can also minimize damage to the underlying substrate when laser engraving is used to remove a portion of the inkjet coating. The thicker the inkjet coating, the more heat that is generated during laser engraving, thereby increasing the heat exposure to the underlying substrate, which in some circumstances can be damaged by heat exposure. One example of substrate that can be damaged by heat exposure is a strengthened glass substrate, for example an ion-exchanged, chemically strengthened glass substrate.

The laser used in the laser engraving must be of a wavelength that is strongly absorbed by the ink layer 28 but not by the substrate 20. Thus the material of the substrate and the ink coating can be factors in determining the laser used. A laser that has a wavelength that is more strongly absorbed by ink layer 28 than substrate 20 can be advantageous in order to minimize or avoid damage to the underlying substrate. If substrate 20 absorbs the wavelength of the laser than it can compromise the optical properties (for example, transmittance and/or reflectance of the substrate) and mechanical properties (for example, mechanical strength of the substrate, resistance to cracking, and/or compressive stress) of substrate 20. The laser could be an infrared laser having a wavelength in a range from 700 nm to 1 mm, a green laser having a wavelength from 495 nm to 570 nm, or a UV laser having a wavelength from 10 nm to 380 nm, for example. In some embodiments, the laser power and or density can be adjusted or defocused to avoid damage to the underlying substrate. The Gaussian nature of power distribution within the laser spot can create a band of darkened, partially burned ink layer along the edge of the laser engraving pattern that still firmly adheres to the substrate surface. The thickness of this band can be minimized in some embodiments.

Figure 5:
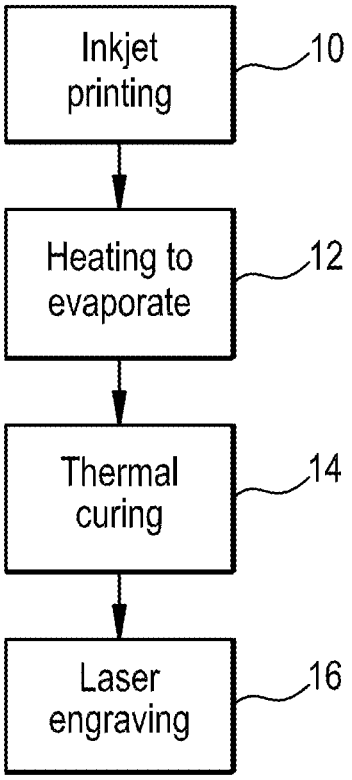
FIG. 5 a second exemplary process for applying decorative coatings to surfaces of substrates.

In some embodiments, as shown for example, in FIG. 5, the process can include steps 10 (inkjet printing), 12 (heating to evaporate), and 14 (thermal curing) as described above with reference to FIG. 1 and can also include the additional step 16 of printing additional features of the decoration after step 14. Depending on the desired decoration function and properties, additional ink layers may be disposed on substrate 20 to complete the decorative pattern. In one or more embodiments, the additional ink layers can be applied by inkjet printing, as otherwise described herein. In other embodiments, the additional ink layers can be applied by other methods other than inkjet printing. For example, some decorative designs require opaque white background to fully realize the brilliance of color, which can be more effectively achieved by screen printing than inkjet printing. Some ink features, such as metallic colors or IR/UV transparent coatings, cannot currently be achieved by inkjet printing. These additional features can be printed using existing industrialized processes, such as screen printing, pad printing, or film transfer.

Figure 6:
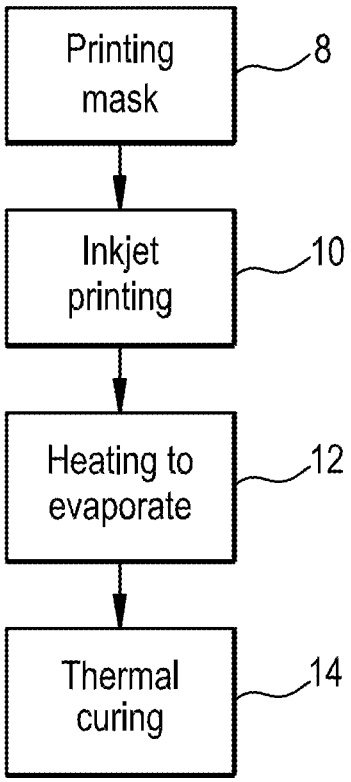
FIG. 6 a third exemplary process for applying decorative coatings to surfaces of substrates.
Figure 7:
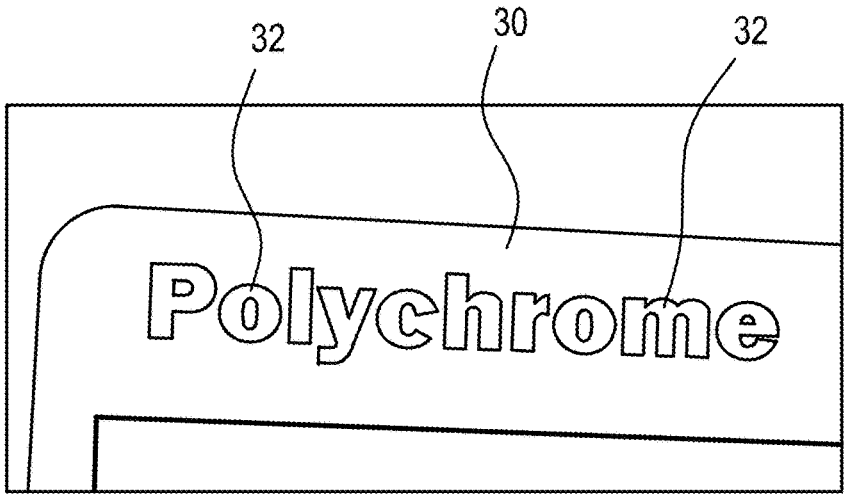
FIG. 7 shows an exemplary mask having openings printed on a substrate according to one or more embodiments.
Figure 8:
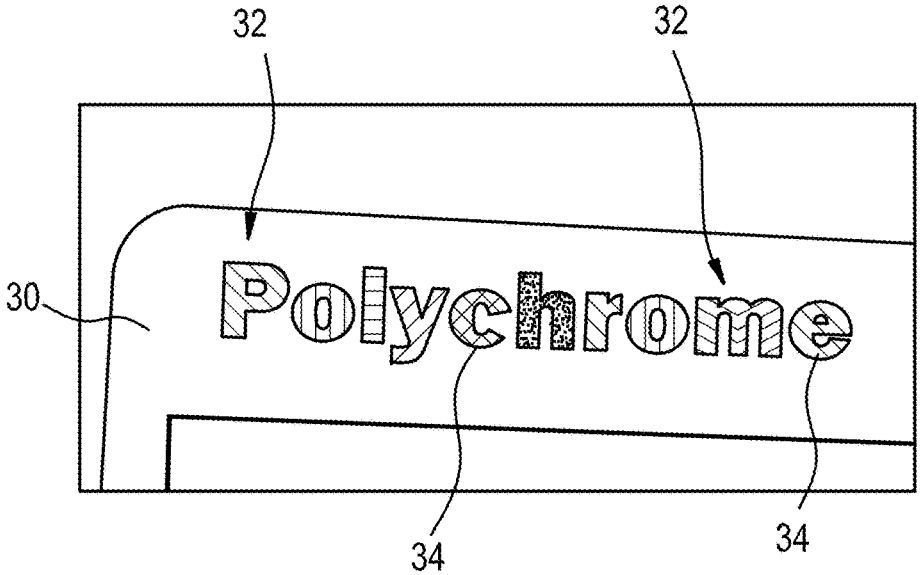
FIG. 8 shows the mask of FIG. 7 wherein the openings are filled with color inks deposited according to one or more embodiments.

In some embodiments, as shown for example in FIG. 6, the process can include steps 10 (inkjet printing), 12 (heating to evaporate), and 14 (thermal curing) as described above with reference to FIG. 1 and can also include the additional step 8 of printing an ink mask on substrate 20 prior to inkjet printing step 10. In some embodiments, as shown in FIG. 7, an ink mask 30 can be printed on surface 22 of substrate 20 that has openings 32 that define a pattern for where to deposit the plurality of inkjet inks in step 10. Openings 32 can be any shape. In FIG. 7 openings 32 are letters that spell the word "polychrome", but this is merely exemplary. In some embodiments, ink mask 30 can be inkjet printed and openings 32 can be formed by a combination of controlling the ink deposition and laser engraving using the methods disclosed in commonly owned U.S. Pub. No. 2015/0103123, which is hereby incorporated by reference in its entirety. In other embodiments, ink mask 30 can be printed using traditional methods such as screen printing, pad printing, or film transfer. In some embodiments, ink mask 30 can be black. In some embodiments, as shown in FIG. 8 once ink mask 30 is cured (using conventional ultraviolet or thermal curing techniques depending upon the ink), step 10 can proceed to fill openings 32 in ink mask 30 with color inks 34. As shown for example in FIG. 8, each of openings 32 can be filled with a different color ink as shown by the different hashmark patterns for each letter. This is merely exemplary. In other embodiments, one or more of the openings 32 can be filled with the same color ink.

EXAMPLE

Figures 9A, 9B, 9C:
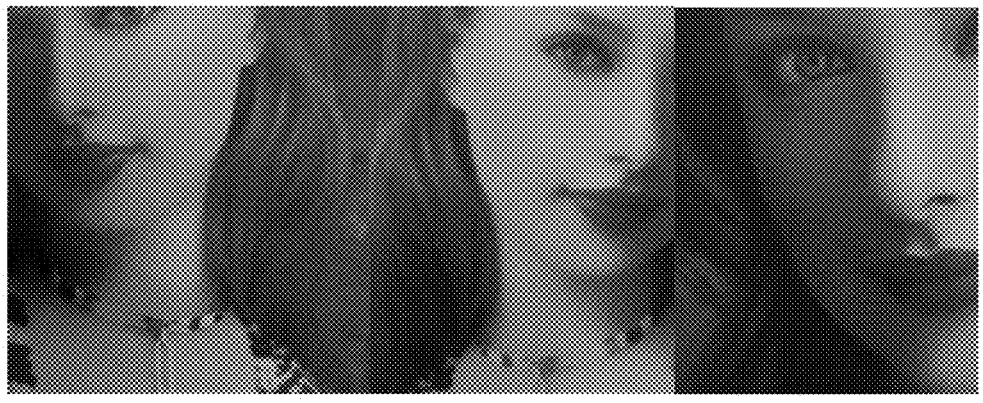
FIGS. 9A-9C are in color and show exemplary photorealistic graphics printed on substrates heated to different temperatures.

A graphic was inkjet printed on a plurality of glass substrates wherein the graphic was inkjet printed onto substrates heated to a different temperature for evaporating the solvents in the inks. A first substrate was not heated and a portion of the resulting graphic is shown in FIG. 9A. A second substrate was heated in a range from 50° C. to 60° C. and the resulting graphic is shown in FIG. 9B. A third substrate was heated to above 70° C. and the resulting graphic is shown in FIG. 9C. It was found that varying the temperature to which the glass substrate was heated changed the resolution of the graphic, with FIG. 9B having the best resolution. For example, not heating the substrate to evaporate the solvents in the inks resulted in blurring of the ink droplets. FIG. 9A shows visible blurring along the neckline and cheek outline, whereas the blurring is not present in FIG. 9B. Overheating the substrate so that the solvents in the inks evaporated to quickly also affected the resolution. FIG. 9C shows noticeable horizontal striations in the printed decoration from drying too rapidly, whereas the striations are not present in FIG. 9B.

While the disclosure has been described with respect to a limited number of embodiments, those skilled in the art, having benefit of this disclosure, will appreciate that other embodiments can be devised which do not depart from the scope of the disclosure as disclosed herein. Accordingly, the scope of the disclosure should be limited only by the attached claims.

The invention claimed is:

1. A method of printing a decoration, comprising:

inkjet printing a plurality of inks to form a layer having a predetermined pattern on a surface of a glass, glass-ceramic, or ceramic substrate, wherein each of the inks includes a solvent and has a different color;

heating the substrate to evaporate at least a portion of the solvent in each of the plurality of inks; and thermally curing the layer on the substrate after evaporating at least the portion of the solvent in each of the plurality of inks to form the decoration, wherein the substrate is heated to a temperature that evaporates at least the portion of the solvent in each of the plurality of inks without fully curing the plurality of inks, wherein a boiling point of the solvent in each of the plurality of inks is within 10° C. of each other, and wherein the adhesion of the inks to the substrate is greater than or equal to 4B according to a cross hatch adhesion test set forth in ASTM D3359-09e2.

2. The method of claim 1, wherein a weight percentage of the solvent in each of the plurality of inks is within 5% of each other.

3. The method of claim 1, wherein the heated substrate has a temperature in a range from about 30° C. to about 70° C.

4. The method of claim 1, wherein each of the plurality of inks is thermally cured at a temperature in a range from about 150° C. to about 250° C.

5. The method of claim 1, wherein the plurality of inks is inkjet printed in droplets and form a drop on the substrate having a diameter of at least 50 μm.

6. The method of claims 1, wherein the layer has a thickness in a range from about 1.5 μm to about 5 μm after curing.

7. The method of claim 1, further comprising disposing an additional layer of ink on the substrate by one of ink jet printing, screen printing, pad printing, or film transfer.

8. The method of claim 1, further comprising laser engraving a portion of the cured layer with a laser having a wavelength to remove a portion of the cured layer, wherein the plurality of inks absorb the wavelength of the laser more than the substrate.

9. The method of claim 1, wherein the plurality of inks are ink jet printed in droplets having a volume in a range from about 1.5 picoliters to about 7 picoliters.

10. The method of claim 1, wherein the solvent in each of the plurality of inks comprises a solvent mixture including at least a first solvent and a second solvent, wherein a boiling point of the first solvent in each of the plurality of inks is within 10° C. of each other and a boiling point of the second solvent in each of the plurality of inks is within 10° C. of each other.

11. The method of claim 10, wherein a weight percentage of the first solvent in each of the plurality of inks is within 5% of each other and a weight percentage of the second solvent in each of the plurality of inks is within 5% of each other.

12. The method of claim 1, wherein the substrate is glass or glass-ceramic.

13. The method of claim 12 wherein the substrate is chemically-strengthened.

14. The method of claim 13, wherein the chemically-strengthened substrate is ion-exchanged.

15. The method of claim 1, wherein the predetermined pattern fills at least one opening in a layer previously applied to the surface.

16. The method of claim 15, further comprising disposing an additional layer of ink on the substrate by one of ink jet printing, screen printing, pad printing, or film transfer.

17. A substrate having a decoration printed thereon according to the method of claim 1.

18. An electronic device comprising the substrate of claim 17.

* * * * *